US008653397B2

(12) United States Patent
Yang

(10) Patent No.: US 8,653,397 B2
(45) Date of Patent: Feb. 18, 2014

(54) CONTACT APPARATUS FOR CIRCUIT BREAKER

(75) Inventor: Jae Min Yang, Chungcheongbuk-Do (KR)

(73) Assignee: LSIS Co., Ltd., Anyang-Si, Gyeonggi-Do (KR)

( * ) Notice: Subject to any disclaimer, the term of this patent is extended or adjusted under 35 U.S.C. 154(b) by 258 days.

(21) Appl. No.: 13/292,945

(22) Filed: Nov. 9, 2011

(65) Prior Publication Data

US 2012/0118710 A1 May 17, 2012

(30) Foreign Application Priority Data

Nov. 17, 2010 (KR) ..... 10-2010-0114663

(51) Int. Cl.
*H01H 33/02* (2006.01)

(52) U.S. Cl.
USPC ..... 218/143

(58) Field of Classification Search
USPC ..... 218/143
See application file for complete search history.

(56) References Cited

U.S. PATENT DOCUMENTS 4,009,458 A * 2/1977 Kishi et al. ..... 218/65
4,338,500 A * 7/1982 Pham Van et al. ..... 218/143
4,439,651 A * 3/1984 Thuries et al. ..... 218/143
5,164,559 A * 11/1992 Pham et al. ..... 218/143
5,276,285 A * 1/1994 Pham et al. ..... 218/143
5,304,760 A * 4/1994 Pham et al. ..... 218/143
5,734,140 A * 3/1998 Hokuto et al. ..... 218/143

* cited by examiner

*Primary Examiner* — Truc Nguyen
(74) *Attorney, Agent, or Firm* — Lee, Hong, Degerman, Kang & Waimey

(57) ABSTRACT

Disclosed herein is a contact apparatus for a circuit breaker, and the circuit breaker may include a stationary electrode portion having a stationary contact; and a movable electrode portion configured to be brought into contact with and separated from the stationary electrode portion, wherein the movable electrode portion includes a movable conductor portion configured to be approached to and spaced from the stationary electrode portion; and a movable contact combined with the movable conductor portion in a relatively movable manner to be brought into contact with and separated from the stationary contact. Through this, it may be possible to alleviate a shock when contacting a contact.

18 Claims, 6 Drawing Sheets

CONTACT APPARATUS FOR CIRCUIT BREAKER

CROSS-REFERENCE TO RELATED APPLICATIONS

Pursuant to 35 U.S.C. §119(a), this application claims the benefit of earlier filing date and right of priority to Korean Patent Application No. 10-2010-0114663, filed on Nov. 17, 2010, the contents of which are hereby incorporated by reference herein in its entirety.

BACKGROUND OF THE INVENTION

1. Field of the Invention

The present disclosure relates to a contact apparatus for a circuit breaker, and more particularly, to a contact apparatus for a circuit breaker for alleviating a shock when contacting a contact.

2. Description of the Related Art

As is generally known, a circuit breaker is a kind of an electrical protector for protecting load devices and power lines when occurring a fault current such as ground fault or short circuit.

The circuit breaker may be classified into an oil circuit breaker using oil as an extinguishing medium, a gas circuit breaker using sulfur hexafluoride ($SF_6$) gas or the like, an air circuit breaker using air as an extinguishing medium, and a vacuum circuit breaker using vacuum insulation strength according to the type of extinguishing medium.

The circuit breaker may include a stationary electrode portion, a movable electrode portion for opening or closing a (main) circuit while being brought into contact with and separated from the stationary electrode portion, and a mechanism unit for providing a driving force to the movable electrode portion.

FIG. 1 is a view illustrating an example of a circuit breaker in the related art, and FIG. 2 is a partial enlarged view of FIG. 1. As illustrated in FIG. 1, a circuit breaker may include an enclosure 10 forming an accommodating space therein, a vacuum circuit breaker 20 disposed at an inner portion of the enclosure 10, and a mechanism unit 50 disposed at a side of the enclosure 10 to provide a driving force to the vacuum circuit breaker 20.

The vacuum circuit breaker 20, as illustrated in FIG. 2, may include a vacuum container 21 for forming vacuum therein, a stationary electrode portion 30 fixed and disposed at a side of the vacuum container 21, and a movable electrode portion 40 disposed to be brought into contact with and separated from the stationary electrode portion 30.

The stationary electrode portion 30 may include a stationary contact 31, and a stationary conductor portion 33 formed to be electrically conducted to the stationary contact 31. A bushing 70 electrically connected to either one of a busbar or load may be provided at a side of the stationary electrode portion 30.

The movable electrode portion 40 may include a movable contact 41 disposed to be brought into contact with and separated from the stationary contact 31, and a movable conductor portion 43 one side of which is connected to the movable contact 41 in an electrically conductive manner and the other side of which is extended out of the vacuum container 21 in a relatively movable manner. A bushing 70 connected to either one of a busbar or load may be provided at a side of the movable electrode portion 40.

The mechanism unit 50 may include a plurality of links, springs, motors, and the like to provide a necessary driving force such that the movable electrode portion 40 is promptly brought into contact with and separated from the stationary electrode portion 30.

A power transfer mechanism 60 for transferring a driving force of the mechanism unit 50 to the movable electrode portion 40 may be provided between the movable electrode portion 40 and the mechanism unit 50.

However, in such a circuit breaker in the related art, since the movable conductor portion 43 and the movable contact 41 constituting the movable electrode portion 40 may be configured in an integrated manner, a mass of the movable electrode portion 40 may be relatively larger during a closing operation, thereby causing an excessive shock when contacting a contact. Due to this, the damage of a component may occur.

SUMMARY OF THE INVENTION

In order to solve the foregoing problem, an object of the present disclosure is to provide a contact apparatus for a circuit breaker capable of alleviating a shock when contacting a contact.

Furthermore, according to the present invention, another object of the present disclosure is to provide a contact apparatus for a circuit breaker capable of alleviating a shock to suppress the damage of a component when contacting a contact.

In order to accomplish the foregoing objectives of the present invention, there is provided a contact apparatus for a circuit breaker, and the apparatus may include a stationary electrode portion having a stationary contact; and a movable electrode portion configured to be brought into contact with and separated from the stationary electrode portion, wherein the movable electrode portion includes a movable conductor portion configured to be approached to and spaced from the stationary electrode portion; and a movable contact combined with the movable conductor portion in a relatively movable manner to be brought into contact with and separated from the stationary contact.

Here, the apparatus may further include an elastic member exerting an elastic force such that the movable contact is protruded from the movable conductor portion.

The apparatus may further include a contact band interposed between the movable conductor portion and the movable contact in an electrically conductive manner.

Meanwhile, according to another field of the present invention, there is provided a contact apparatus for a circuit breaker, and the apparatus may include a stationary electrode portion having a stationary contact; and a movable electrode portion configured to be brought into contact with and separated from the stationary electrode portion, wherein the movable electrode portion includes a movable conductor portion configured to be approached to and spaced from the stationary electrode portion; a movable contact configured to be relatively moved with respect to the movable conductor portion and brought into contact with and separated from the stationary contact; and a cantilever configured to be transversely protruded with respect to a moving direction of the movable contact and pressed to the side of the stationary contact by the movable conductor portion.

Here, the apparatus may further include a slider disposed at an inner portion of the movable contact in a relatively movable manner, and moved to the side of the stationary contact to press an end portion of the cantilever to the side of the stationary contact when the movable contact is brought into contact with the stationary contact.

The slider may include a slot such that an end portion of the cantilever is inserted to a predetermined depth to be relatively moved.

Cantilever contacting portions may be formed at both end portions of the slot, respectively, to be brought into contact with the cantilever.

The contact apparatus for a circuit breaker may further include a slider fixing unit configured to fix the slider moved to the side of the stationary contact when the movable contact is brought into contact with the stationary contact.

The slider fixing unit may include a key disposed with respect to the slide in a relatively movable manner, and further protruded to the side of the stationary contact from the slider moved to the side of the stationary contact; and a locking unit revolvably disposed at a side of the slider to be revolved between a locking position engaged with the stationary contact and a releasing position for releasing the engagement after the slider is moved to the stationary contact.

The contact apparatus for a circuit breaker may further include a locking unit spring exerting an elastic force such that the locking unit is revolved to the locking position.

A space portion may be provided at the stationary contact such that the locking unit is revolved to the locking position, and a latching protrusion engaged with the locking unit may be provided at a side of the spacing unit.

The contact apparatus for a circuit breaker may include a plurality of locking units, and the latching protrusion may be formed to allow the locking unit to pass therethrough.

The contact apparatus for a circuit breaker may further include a key driving unit configured to relatively move the key with respect to the movable conductor portion.

The key driving unit may drive the key in interlock with the contact portion.

The key driving unit may include a first rack teeth-shaped portion formed on the movable contact; a second rack teeth-shaped portion formed on the key; a first gear combined with the first rack teeth-shaped portion; and a second gear combined with the first gear on the same shaft and combined with the second rack teeth-shaped portion.

The first gear may be formed to have a rotational radius less than that of the second gear.

The first and the second gear may have a predetermined gear ratio such that a relative moving distance of the key is larger than a relative moving distance of the movable contact.

The contact apparatus for a circuit breaker may include a plurality of the key driving units.

The key driving unit may be disposed to face each other by interposing the key.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Hereinafter, an embodiment of the present invention will be described in detail with reference to the accompanying drawings.

Figure 3:
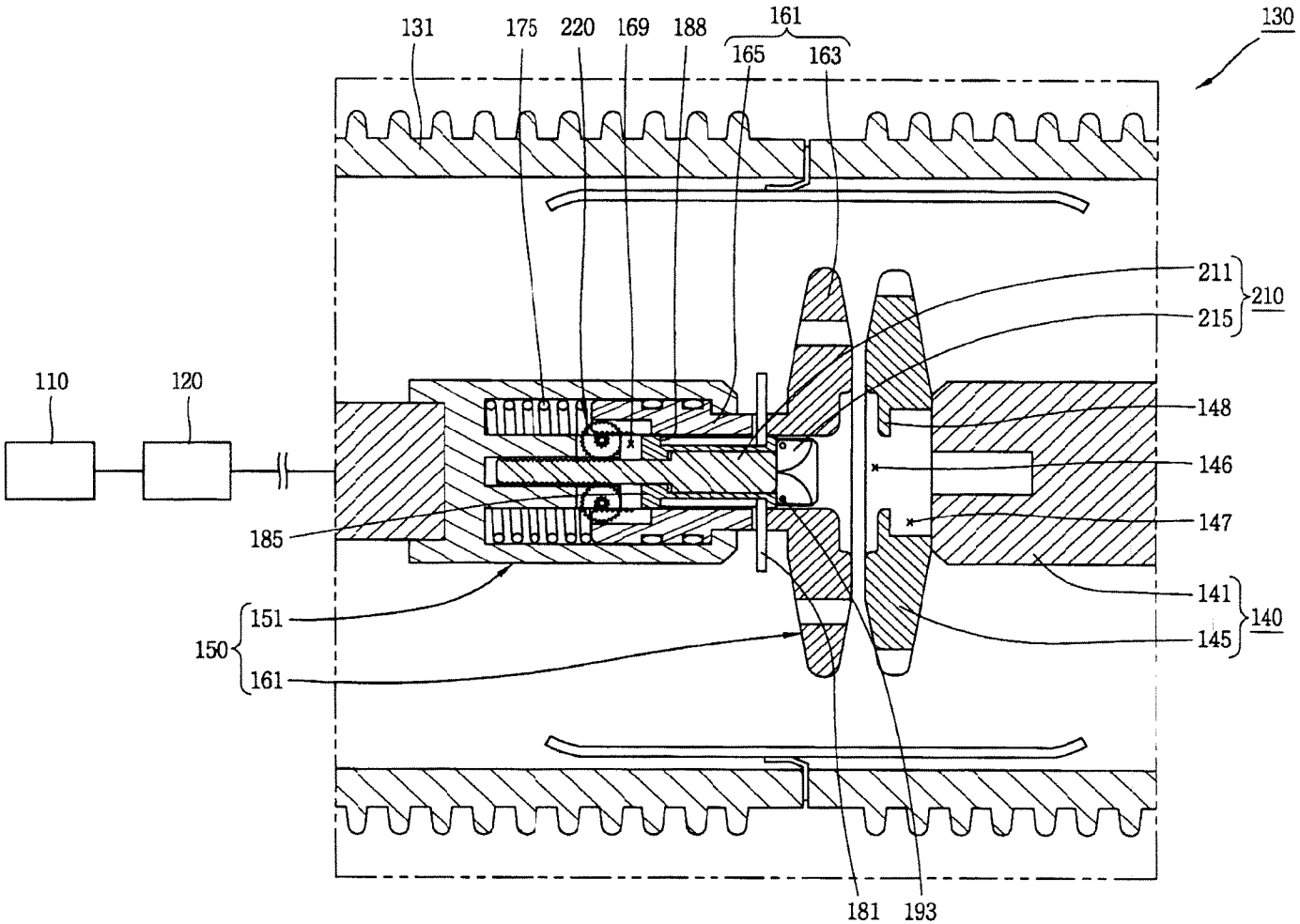
FIG. 3 is a cross-sectional view illustrating a contact apparatus for a circuit breaker according to an embodiment of the present invention.
Figure 4:
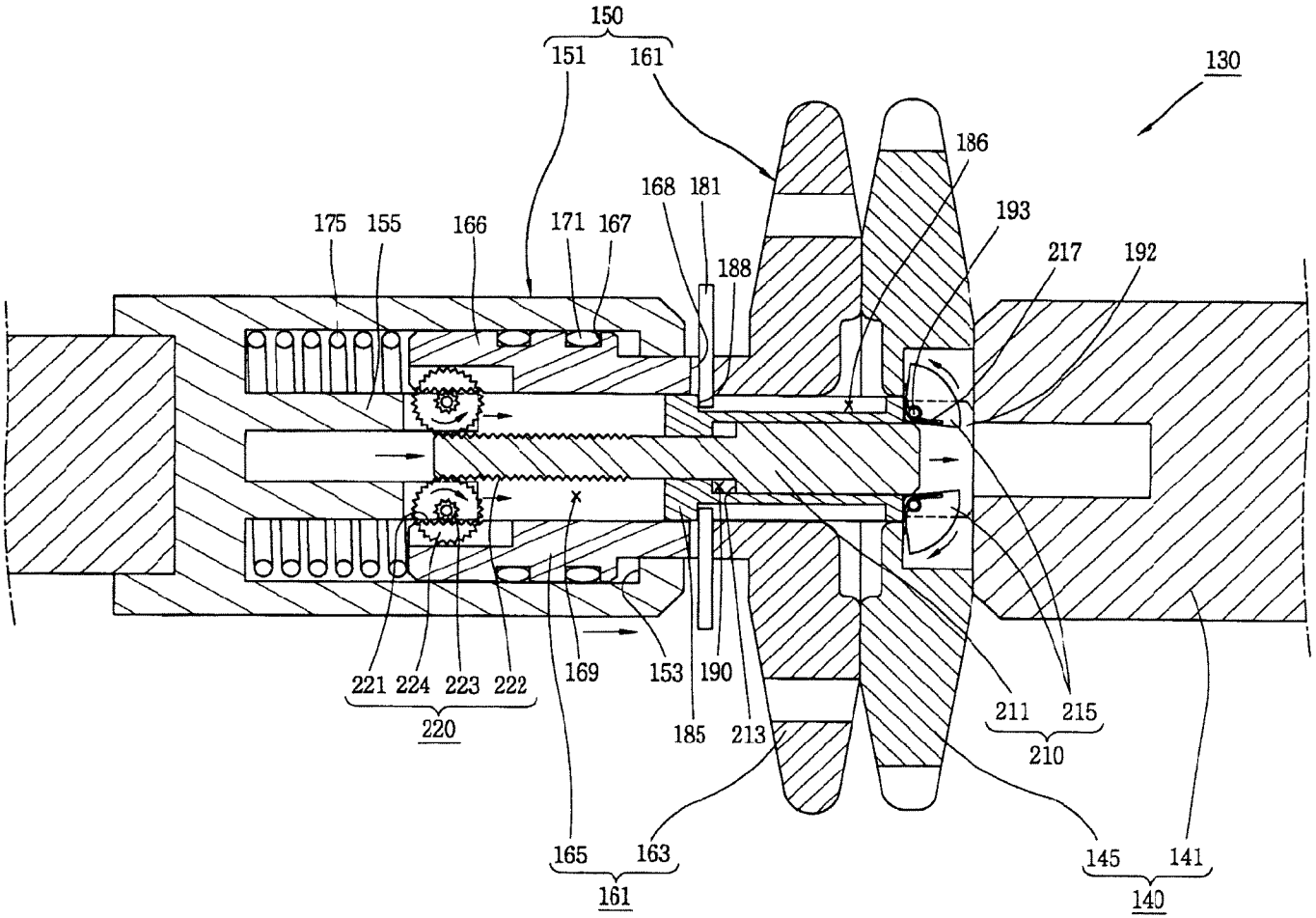
FIGS. 4 through 6 are views for explaining the operation of the contact apparatus in FIG. 3.

As illustrated in FIGS. 3 and 4, a contact apparatus 130 of the circuit breaker according to the present invention may include a stationary electrode portion 140 having a stationary contact 145, and a movable electrode portion 150 configured to be brought into contact with and separated from the stationary electrode portion 140, wherein the movable electrode portion 150 includes a movable conductor portion 151 configured to be approached to and spaced from the stationary electrode portion, and a movable contact 161 combined with the movable conductor portion 151 in a relatively movable manner to be brought into contact with and separated from the stationary contact 145.

Figure 1:
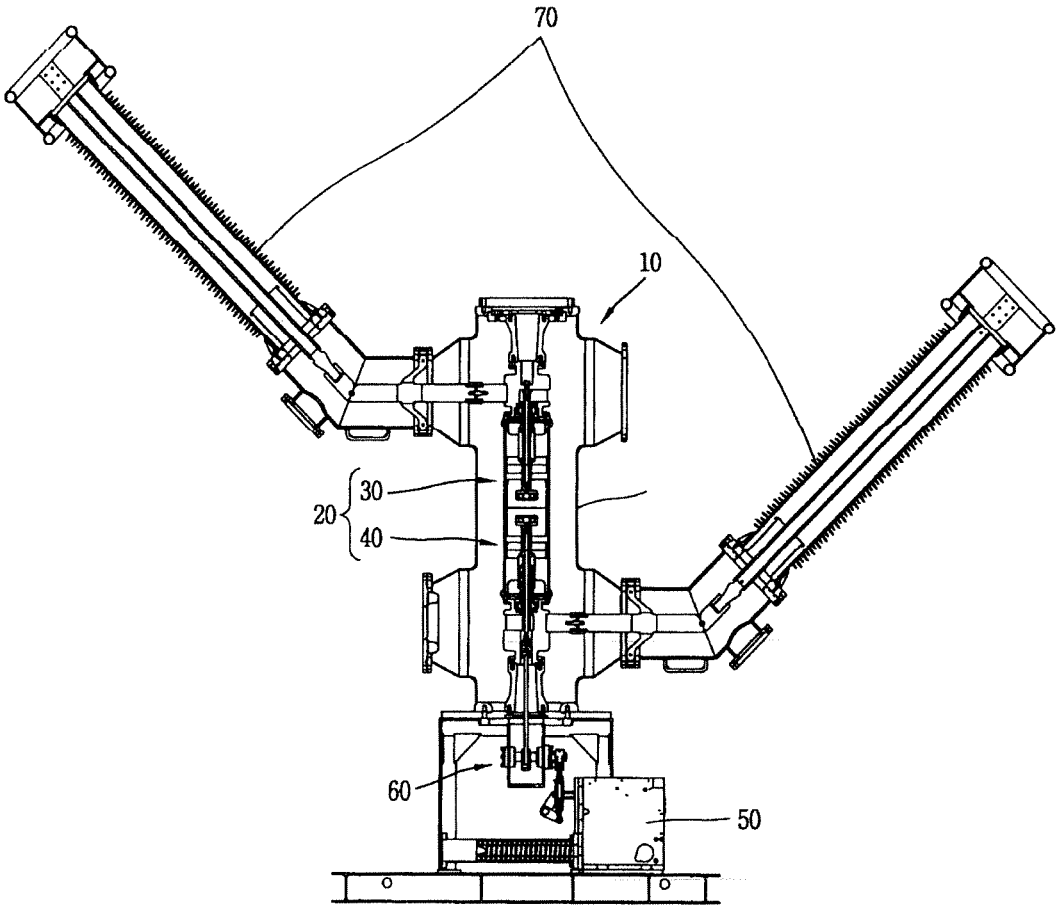
FIG. 1 RELATED ART
FIG. 1 is a cross-sectional view illustrating a region of a circuit breaker in the related art.
Figure 2:
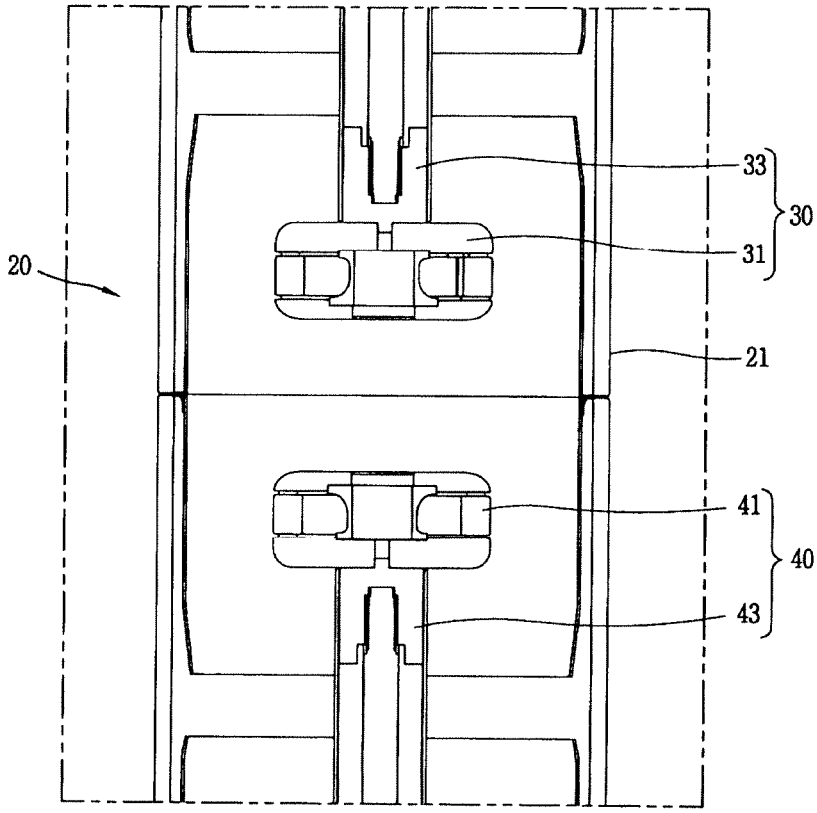
FIG. 2 RELATED ART
FIG. 2 is a view illustrating an inner portion of the circuit breaker in FIG. 1.

Here, a contact apparatus 130 of the circuit breaker according to the present invention may include a vacuum container 131 for accommodating the stationary electrode portion 140 and the movable electrode portion 150 therein to maintain the inner portion thereof in a vacuum state. Furthermore, the contact apparatus 130 may include a manipulation mechanism 110 for providing a driving force to drive the movable electrode portion 150, and a power transfer mechanism 120 for transferring a driving force of the manipulation mechanism 110 to the movable electrode portion 150. The manipulation mechanism 110 and power transfer mechanism 120 have the same configuration as those of the related art in FIG. 1, and thus the detailed description thereof will be omitted.

The stationary electrode portion 140 may include the stationary contact 145 and a stationary conductor portion 141 extended from the stationary contact 145. The proximity sensor 141 and the stationary contact 145 may be formed in an integrated manner. The stationary contact 145 may be configured to have a disc shape having an enlarged diameter compared to that of the proximity sensor 141.

The movable electrode portion 150 may include a movable conductor portion 151 configured to be approached to and spaced from the movable electrode portion 150, and a movable contact 161 combined with the movable conductor portion 151 in a relatively movable manner to be brought into contact with and separated from the stationary contact 145. Through this, it may be possible to reduce an impact when the movable contact 161 is impactively brought into contact with the stationary contact 145, and suppress the damage of a component by an excessive impact. Here, the movable conductor portion 151 may be configured to connect to a main circuit push load or ground circuit push load of the power transfer mechanism 120 to receive a driving force.

The movable contact 161 may include a disc-shaped contact portion 163 brought into contact with the stationary contact 145 and a body 165 extended to a side of the contact portion 163. The body 165 may include an enlarged portion 166 formed to have an increased radius. The enlarged portion 166 may be inserted into an inner portion of the movable conductor portion 151. A movable contact contacting portion 153 may be formed at the movable conductor portion 151 to be brought into contact with the enlarged portion 166. Through this, the protrusion of the movable contact 161 may be limited with respect to the movable conductor portion 151, and moreover, the movable contact 161 may be moved in the direction of getting away from the stationary contact 145 by the movement of the movable conductor portion 151.

The movable contact 161 may be configured with a hollow body having a space therein. More specifically, the hollow portion 169 may be formed at the center of the body 165 and contact portion 163.

A contact band 171 for may be provided between the movable conductor portion 161 and the movable conductor portion 151 to connect both sides (the movable contact 161 and the movable conductor portion 151) to each other in an electrically conductive manner. More specifically, a contact band accommodating portion 167 may be formed in a depressed manner at the enlarged portion 166 of the movable contact 161 to accommodate the contact band 171 in a combined manner. Through this, the movable contact 161 and the movable conductor portion 151 may be electrically conducted to each other while being relatively moved to each other.

The movable conductor portion 151 may be configured such that part of the movable contact 161 is inserted therein in a relatively movable manner. More specifically, an end portion of the body 165 of the movable contact 161 may be inserted into an inner portion of the movable conductor portion 151.

An elastic member 175 exerting an elastic force such that the movable contact 161 is protruded from the movable conductor portion 151 may be provided at an inner portion of the movable conductor portion 151. The elastic member 175 may be configured with a compression coil spring. Furthermore, the elastic member 175 may be configured with a plurality of disc springs having a disc shape.

According to the foregoing configuration, the movable electrode portion 150 may be moved to the side of the stationary electrode portion 140 by the power transfer mechanism 120 when performing a closing operation to electrically conduct the power of the main circuit of the circuit breaker. First of all, the movable contact 161 may be brought into contact with the stationary contact 145 to suspend the movement. At this time, the movable contact 161 may be in a state of continuously moving to the side of the stationary electrode portion 140 while compressing the elastic member 175, thereby reducing an impact when the movable contact 161 is brought into contact with the stationary contact 145.

Meanwhile, a contact apparatus 130 of the circuit breaker according to the present invention may include cantilever 181 configured to be transversely protruded with respect to a moving direction of the movable contact 161 and pressed to the side of the stationary contact 145 by the movable conductor portion 151. A plurality of cantilevers 181 may be provided therein.

A through portion 168 may be provided at the movable electrode portion 150 to insert the cantilever 181 therein. More specifically, the through portion 168 may be formed to pass through a lateral portion of the body 165 of the movable contact 161.

A contact apparatus 130 of the circuit breaker according to the present invention may include a slider 185 disposed at an inner portion of the movable contact 161 in a relatively movable manner, and moved to the side of the stationary contact 145 to press an end portion of the cantilever 181 to the side of the stationary contact 145 when the movable contact 161 is brought into contact with the stationary contact 145.

The slider 185 may be disposed at the hollow portion 169 of the movable electrode portion 150. The movable electrode portion 150 and the slider 185 may be configured such that the slider 185 moves back and forth along an axial direction of the movable electrode portion 150.

The slider 185 may be protruded from the movable electrode portion 150 to insert a portion thereof into the stationary electrode portion 140. To this end, an insertion portion 146 may be formed at the stationary contact 145 of the stationary electrode portion 140. The insertion portion 146 may be formed in a depressed manner to a predetermined depth at the central region of the stationary contact 145.

The slider 185 may include a slot 186 such that an end portion of the cantilever 181 is inserted to a predetermined depth to be relatively moved. The slot 186 may be formed in a depressed manner to a predetermined depth along a radial direction from an outer surface of the slider 185. The slot 186 may be formed to have a length shorter than that of the slider 185. A cantilever contacting portion 188 may be formed at a side of the slot 186 to be brought into contact with the cantilever 181. Through this, the cantilever 181 and the cantilever contacting portion 188 may be brought into contact with each other to fix an end portion of the cantilever 181.

The slider 185 may be fixed in a state of being moved to the side of the stationary electrode portion 140 when contacting the contact. A slider fixing unit 210 for fixing the slider 185 when contacting the contact may be provided at a side of the slider 185.

More specifically, the slider fixing unit 210 may include a key 211 disposed with respect to the slider 185 in a relatively movable manner, and further protruded to the side of the stationary contact 145 from the slider 185 moved to the side of the stationary contact 185; and a locking unit 215 revolvably disposed at a side of the slider 185 to be revolved between a locking position engaged with the stationary contact 145 and a releasing position for releasing the engagement after the slider 185 is moved to the stationary contact 145.

A key combining portion 190 may be formed at an inner portion of the slider 185 to accommodate the key 211 in a combined manner. The key 211 may be configured to be relatively moved with respect to the slider 185. The key 211 may be formed to have a length greater than that of the slider 185. A portion of the key 211 may pass through the slider 185 to be protruded out of the slider 185.

Here, the slider 185 and key 211 may be configured such that the key 211 is protruded with respect to the slider 185 in the direction of being approached to the stationary electrode portion 140, and engaged with respect to the slider 185 in the direction of getting away from the stationary electrode portion 140. To this end, the key 211 may be configured such that a diameter (or width) of the withdrawal portion is less than that of the portion of being accommodated into the slider 185 to form a protrusion 213 at a boundary of the portion of being drawn out of the slider 185.

The locking unit 215 may be provided at a side of the slider 185. More specifically, a revolution supporting portion 192 revolvably supporting the locking unit 215 may be provided at the stationary electrode portion 140 side end portion of the slider 185. A revolution shaft 193 revolvably combined with the locking unit 215 may be provided at the revolution supporting portion 192.

The contact apparatus may include a plurality of locking units 215. The locking unit 215 may be configured to have a fan shape. Here, the locking unit 215 may be formed such that an inside angle of two sides thereof is 90 degrees. The locking unit 215 may be disposed such that each side is brought into contact with a front end of the key 211 at the releasing position, and disposed to be revolved around the revolution shaft 193 and protruded in a width direction of the slider 185 at the locking position. Since the key 211 is further protruded to the stationary electrode portion 140 compared to the slider 185 and disposed between the two locking units 215, the inner circumferences of the locking units 215 may be brought into contact with and supported by the key 211 to suppress revolution in the direction of the releasing position.

An elastic means exerting an elastic force may be provided at a side of the locking unit 215 such that the locking unit 215 is revolved to the releasing position. The elastic means may be a locking unit spring 217 implemented by a spring. The locking unit spring 217 may be configured with a torsion coil spring. The locking unit spring 217 may be disposed at the circumference of the revolution shaft 193.

A space portion 147 may be provided at the stationary contact 145 such that the locking unit 215 is revolved to the locking position. A latching protrusion 148 may be formed at the stationary contact 145 such that the locking unit 215 is revolved to the locking position to be engaged with respect to a direction that the movable electrode portion 150 is spaced from the stationary electrode portion 140. Here, the latching protrusion 148 may be configured to be vertically disposed (90 degrees) with respect to the key 211 when the key 211 is protruded. The latching protrusion 148 may be formed such that the locking unit 215 can pass through the central region of the latching protrusion 148. Here, a plurality of (e.g., two) latching protrusions 148 may be configured to be brought into contact with the two locking units 215, respectively. In this case, the latching protrusions 148 may be spaced from each other to allow the locking units 215 to pass through therebetween.

Meanwhile, a key driving unit 220 may be provided to relatively move the key 211 with respect to the movable conductor portion 151. The contact apparatus may include a plurality of key driving units 220. The key driving unit 220 may be disposed to face each other by interposing the key 211.

The key driving unit 220 may include a first rack teeth-shaped portion 221 formed on the movable contact 161, a second rack teeth-shaped portion 222 formed on the key 211, a first gear 223 combined with the first rack teeth-shaped portion 221, and a second gear 224 combined with the first gear 223 on the same shaft and combined with the second rack teeth-shaped portion 222.

A key accommodating portion 155 for accommodating part of the key 211 may be provided at an inner portion of the movable conductor portion 151. The foregoing elastic member 175 exerting an elastic force may be provided at an outside (circumferential surface) of the accommodating portion 155 to protrude the movable contact 161.

The first gear 223 and the second gear 224 may be provided at a side wall of the accommodating portion 155. The first gear 223 and the second gear 224 may be provided at two locations of the side wall of the accommodating portion 155, respectively.

Corresponding to this, the first rack teeth-shaped portion 221 may be formed along the moving direction of the movable electrode portion 150 on the movable contact 161, and the second rack teeth-shaped portion 222 may be formed along the moving direction of the movable electrode portion 150 on the key 211.

The first gear 223 and second gear 224 may be rotatably configured in an integrated manner around the same shaft.

The first gear 223 and second gear 224 may be configured with pinions having different radiuses.

The first gear 223 and second gear 224 may be configured to have a predetermined gear ratio such that a relative moving distance of the key 211 is larger than a relative moving distance of the movable contact 161. Here, the gear ratio may be suitably set (for example, about 1:4 or 1:6) by taking the relative moving distance of the key 211 into consideration. Through this, the key 211 may be promptly protruded from the slider 185 and promptly moved to the side of the stationary contact 145 when two contacts are brought into contact with each other.

Through this configuration, when a driving force of the manipulation mechanism 110 is transferred to the movable electrode portion 150 by the power transfer mechanism 120 when performing a closing operation of the circuit breaker, the movable electrode portion 150 may be moved to the side of the stationary electrode portion 140. First, the movable contact 161 is brought into contact with the stationary contact 145 to suspend the movement of the movable contact 161.

At this time, the movable conductor portion 151 is continuously moved to the side of the stationary electrode portion 140 while compressing the elastic member 175, and therefore, only the movable contact 161 is suspended first when two contacts are brought into contact with each other, thereby significantly reducing an impact being applied to the stationary contact 145.

The movable conductor portion 151 is continuously moved to the side of the stationary electrode portion 140 with respect to the movable contact 161 while at the same time suspending the movement of the movable contact 161, and at this time, the key 211 and the slider 185 are moved to the side of the stationary electrode portion 140 by the key driving unit 220 as illustrated in FIG. 4. At this time, the first gear 223 is teeth combined with the first rack teeth-shaped portion 221, and thus the first gear 223 is rotated when the movable conductor portion 151 is moved to the side of the stationary electrode portion 140.

When the first gear 223 is rotated, the second gear 224 being rotated together with the first gear 223 in an integrated manner is rotated at the same time. When the second gear 224 is rotated, the second rack teeth-shaped portion 222 teeth combined with the second gear 224 is promptly moved to the side of the stationary electrode portion 140 at an increased speed.

The front end portion, more specifically the revolution supporting portion 192, of the slider 185 moved to the side of the stationary electrode portion 140 is brought into contact with the stationary conductor portion 141, and thus the movement is suspended, and the key 211 is moved in a manner more protrudable from the slider 185.

Figure 5:
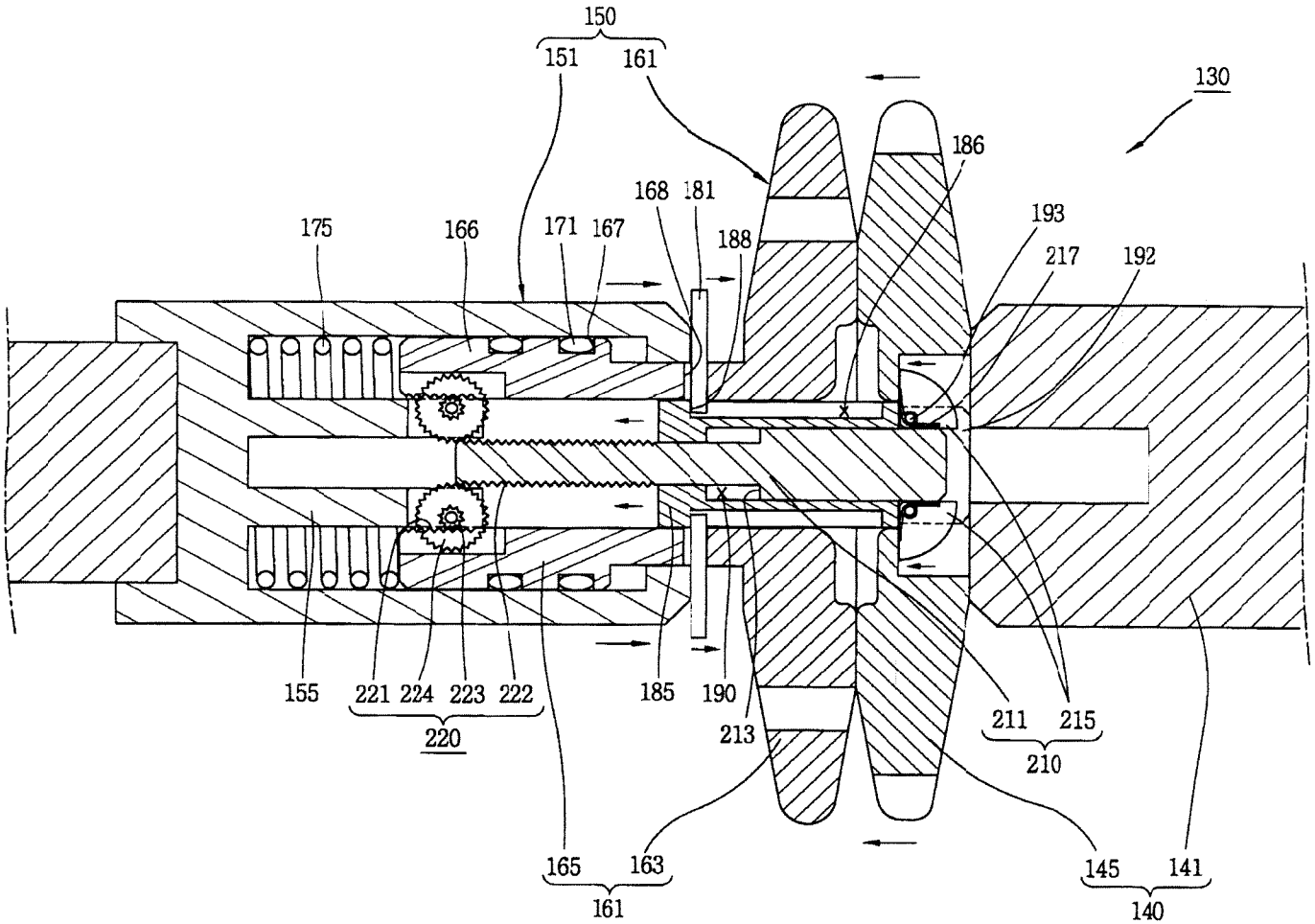

Meanwhile, if the slider 185 is inserted into an inner portion of the insertion portion 146 of the stationary contact 145, then the locking unit 215 disposed at an inner portion of the space portion 147 is pressed by the movement of the key 211 and revolved to the locking position as illustrated in FIG. 5. The locking unit 215 is brought into contact with the key 211 to suppress the revolution to the releasing position.

The locking unit 215 revolved to the locking position is brought into contact with the latching protrusion 148, and thus the key 211 is engaged (restrained) with respect to the direction of getting away from the stationary contact 145 to suppress the movement of the slider 185 in the direction of being separated from the stationary contact 145. Through this, an end portion of the cantilever 181 may be fixed (supported).

The movable conductor portion 151 is continuously moved to the side of the stationary electrode portion 140, and brought into contact with an outer end portion of the cantilever 181 an inner end portion of which is fixed and supported by the slider 185 to press the cantilever 181 to the side of the stationary contact 145 as illustrated in FIG. 5. At this time, forces having an opposite direction of action to each other and using a contact portion of the side wall of the through portion 168 as a point of action are applied to both ends portion of the cantilever 181.

In other words, if an outer end portion of the cantilever 181 is pressed to the side of the stationary contact 145 by the movable conductor portion 151, then an inner end portion of the cantilever 181 presses the slider 185 in the direction of getting away from the stationary contact 145. Accordingly, a pressing force applied to the slider 185 is continuously applied the key 211, the locking unit 215, and the latching protrusion 148 of the stationary contact 145, and as a result transferred in such a manner that the stationary contact 145 is pressed to the side of the movable contact 161. Through this, the movable contact 161 and the stationary contact 145 can be more closely adhered to each other, thereby effectively responding to an electromagnetic repulsive force applied between two contacts. Here, when the movable conductor portion 151 is brought into contact with the cantilever 181 at a further outside to press the cantilever 181, the stationary contact 145 may be pressed to the side of the movable contact 161 with a further amplified force.

Figure 6:
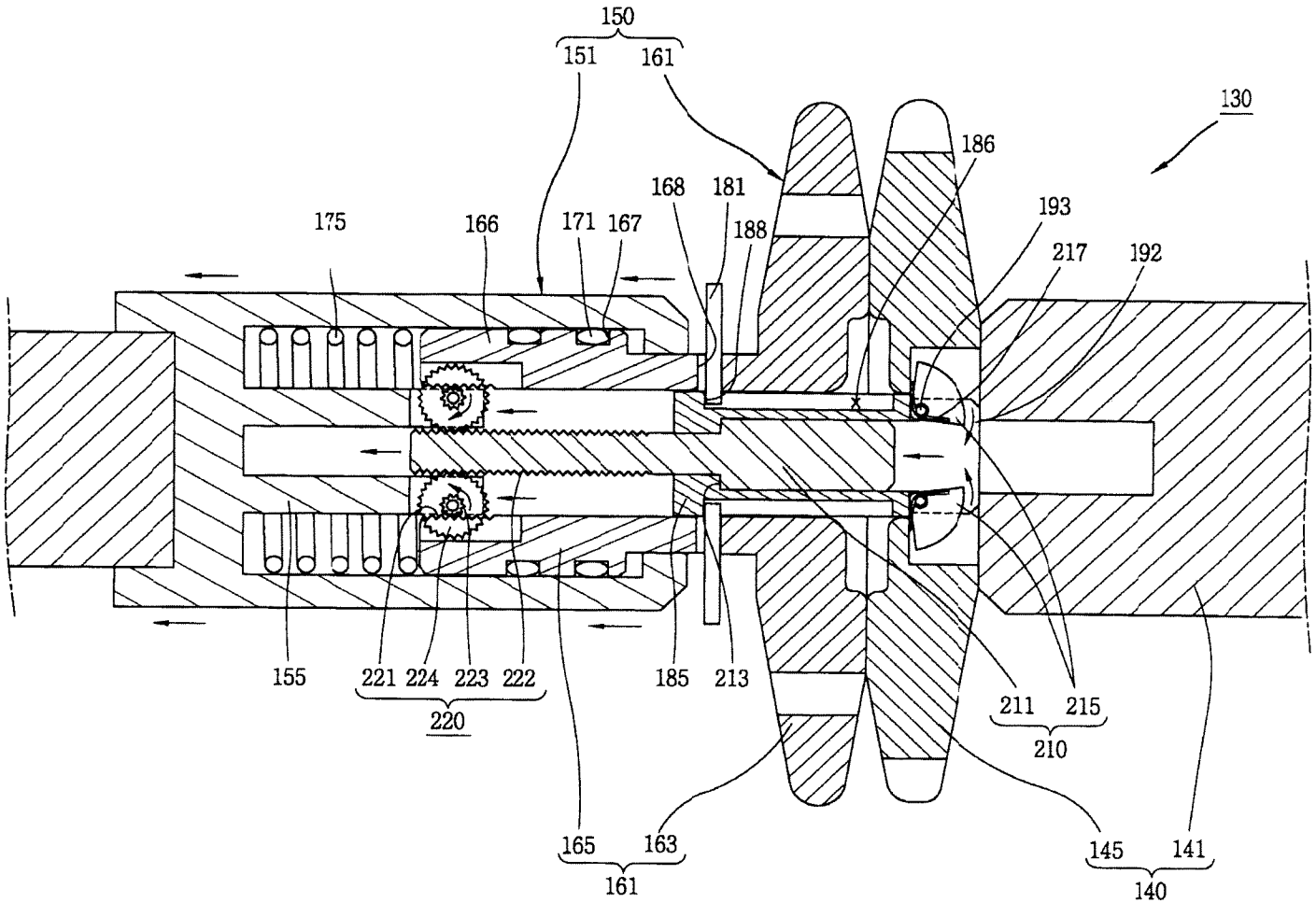

Meanwhile, if the power of the circuit breaker is open, then a driving force of the manipulation mechanism 110 is transferred to the movable electrode portion 150 by the power transfer mechanism 120. Through this, the movable electrode portion 150 is moved in the direction of being spaced from the stationary electrode portion 140 as illustrated in FIG. 6. At this time, the movable contact 161 is fixed by the slider fixing unit 210 in a state of being brought into contact with the stationary contact 145, and thus the movable conductor portion 151 is first moved in the direction of being spaced from the stationary electrode portion 140.

If the movable conductor portion 151 initiates the movement, then the first gear 223 engaged with the first rack teeth-shaped portion 221 is rotated, and if the second gear 224 formed together with the first gear 223 in an integrated manner is rotated at the same time, then the key 211 (and slider 185) is promptly moved in the direction of being separated from the stationary contact 145.

If the key 211 is moved to be separated from the stationary contact 145 and the restriction of the locking unit 215 is released, then the locking unit 215 is revolved to the releasing position by an elastic force of the locking unit spring 217.

The key 211 and slider 185 are continuously moved in the direction of getting away from the stationary contact 145 by the key driving unit 220, and the movable contact 161 is separated and moved from the stationary contact 145 when the movable contact contacting portion 153 of the movable conductor portion 151 is brought into contact with the enlarged portion 166 of the movable contact 161.

As described above, according to an embodiment of the present invention, a movable electrode may be configured with a movable contact and a movable conductor portion that are relatively moved to each other to reduce a mass when contacting a contact, thereby alleviating an impact. Through this, it may be possible to suppress the damage caused to a component due to an excessive impact.

Furthermore, a cantilever may be provided such that a movable contact is pressed to the side of a stationary contact as well as the stationary contact is pressed to the side of the movable contact, thereby effectively responding to an electromagnetic repulsive force applied between two contacts.

In addition, a cantilever is provided therein to reduce a manipulating force for closing (driving) a movable electrode portion, thereby reducing the capacity of a manipulation mechanism.

As described above, specific embodiments of the present invention are illustrated and described herein. However, the present invention can be implemented in various embodiments without departing from the spirit or gist of the invention, and thus the foregoing embodiments should not be limited to the content of the detailed description.

Furthermore, the foregoing embodiments should be broadly construed within the scope of the technical spirit defined by the appended claims even though they are not specifically disclosed in the detailed description herein. Moreover, all changes and modifications within the technical scope of the claims and the equivalent scope thereof should be construed to be included in the appended claims.

What is claimed is:

1. A contact apparatus for a circuit breaker, the apparatus comprising:

a stationary electrode portion having a stationary contact; and a movable electrode portion configured to be brought into contact with and separated from the stationary electrode portion, wherein the movable electrode portion comprises:

a movable conductor portion configured to be brought close to and separated from the stationary electrode portion;

a movable contact combined with and configured to move relative to the movable conductor portion such that the movable contact can be brought into contact with or separated from the stationary contact; and a contact band interposed between the movable conductor portion and the movable contact and configured to be electrically conductive.

2. The apparatus of claim 1, further comprising:

an elastic member configured to exert an elastic force such that the movable contact is protruded from the movable conductor portion.

3. A contact apparatus for a circuit breaker, the apparatus comprising:

a stationary electrode portion having a stationary contact; and a movable electrode portion configured to be brought into contact with and separated from the stationary electrode portion, wherein the movable electrode portion comprises:

a movable conductor portion configured to be brought close to and separated from the stationary electrode portion;

a movable contact configured to move relative to the movable conductor portion such that the movable contact can be brought into contact with or separated from the stationary contact; and a cantilever configured to protrude transversely with respect to a moving direction of the movable contact and to be pressed to a side of the stationary contact by the movable conductor portion.

4. The apparatus of claim 3, further comprising:

a slider disposed at an inner portion of the movable contact and configured to move relative to the movable contact such that the slider can be moved to the side of the stationary contact to press an end portion of the cantilever to the side of the stationary contact when the movable contact is brought into contact with the stationary contact.

5. The apparatus of claim 4, wherein the slider comprises a slot into which an end portion of the cantilever is inserted to a predetermined depth such that the cantilever can be moved relative to the slot.

6. The apparatus of claim 5, wherein each end portion of the slot has a cantilever contacting portion configured to be brought into contact with the cantilever.

7. The apparatus of claim 4, further comprising:

a slider fixing unit configured to fix the slider at the side of the stationary contact when the movable contact is brought into contact with the stationary contact.

8. The apparatus of claim 7, wherein the slider fixing unit comprises:

a key disposed such that the key is movable relative to the slider and configured to protrude to the side of the stationary contact when the slider is moved to the side of the stationary contact; and a locking unit disposed at a side of the slider and configured to move between a locking position engaged with the stationary contact and a releasing position in which the engagement is released after the slider is moved to the stationary contact.

9. The apparatus of claim 8, further comprising:

a locking unit spring configured to exert an elastic force such that the locking unit is moved to the locking position.

10. The apparatus of claim 8, wherein:

a space portion is provided at the stationary contact such that the locking unit is moved to the locking position; and a latching protrusion engaged with the locking unit is provided at a side of the spacing portion.

11. The apparatus of claim 10, wherein:

the locking unit comprises a plurality of locking units; and the latching protrusion is formed such that the plurality of locking units pass through the latching protrusion.

12. The apparatus of claim 8, further comprising:

a key driving unit configured to move the key relative to the movable conductor portion.

13. The apparatus of claim 12, wherein the key driving unit is further configured to move the key such that the key is interlocked with the contact portion.

14. The apparatus of claim 13, wherein the key driving unit comprises:

a first rack teeth-shaped portion formed on the movable contact;

a second rack teeth-shaped portion formed on the key;

a first gear combined with the first rack teeth-shaped portion; and a second gear combined with the first gear on a same shaft and combined with the second rack teeth-shaped portion.

15. The apparatus of claim 14, wherein the first gear is formed to have a rotational radius that is smaller than a rotational radius of the second gear.

16. The apparatus of claim 14, wherein the first gear and the second gear have a predetermined gear ratio such that a relative moving distance of the key is greater than a relative moving distance of the movable contact.

17. The apparatus of claim 14, wherein the key driving unit comprises a plurality of key driving units.

18. The apparatus of claim 17, wherein the plurality of key driving units are disposed such that each of the plurality of key driving units faces one another by interposing the key.

* * * * *